US006939236B2

(12) United States Patent
McLaren et al.

(10) Patent No.: US 6,939,236 B2
(45) Date of Patent: Sep. 6, 2005

(54) ROTARY SKI SLOPE

(75) Inventors: David McLaren, Scotland (GB); Rolf Fyne, Streatlry (GB)

(73) Assignee: Snowvolution Limited, Edinburgh (GB)

( * ) Notice: Subject to any disclaimer, the term of this patent is extended or adjusted under 35 U.S.C. 154(b) by 0 days.

(21) Appl. No.: 10/311,923

(22) PCT Filed: Jun. 19, 2001

(86) PCT No.: PCT/GB01/02709

§ 371 (c)(1),
(2), (4) Date: Feb. 3, 2003

(87) PCT Pub. No.: WO01/97932

PCT Pub. Date: Dec. 27, 2001

(65) Prior Publication Data

US 2003/0153392 A1 Aug. 14, 2003

(30) Foreign Application Priority Data

Jun. 19, 2000 (GB) ..... 0014977

(51) Int. Cl.[7] ..... A63C 19/10
(52) U.S. Cl. ..... 472/90; 472/91
(58) Field of Search ..... 472/88–94, 137

(56) References Cited

U.S. PATENT DOCUMENTS 3,195,889 A * 7/1965 Hall ..... 472/91
4,148,477 A * 4/1979 Larson ..... 472/91
5,184,980 A * 2/1993 Ferris ..... 472/91
5,241,830 A * 9/1993 Morioka et al. ..... 62/91
5,413,545 A * 5/1995 Bermann ..... 482/71
5,649,865 A * 7/1997 Harvey ..... 472/90

FOREIGN PATENT DOCUMENTS

| | | |
|---|---|---|
| DE | 2410126 | 9/1975 |
| GB | 2272382 A | 5/1994 |
| WO | WO 89/04703 | 6/1989 |
| WO | WO 89/02771 | 4/1999 |

* cited by examiner

*Primary Examiner*—Kien Nguyen
(74) *Attorney, Agent, or Firm*—Brooks Kushman P.C.

(57) ABSTRACT

A rotary ski slope comprising an inclined disc which is rotatable about an axis and has a diameter of at least 100 meters. The disc may be divided into a number of concentric rings (1) which are rotatable at different speeds. Means are preferably provided to circulate coolant across the entire under surface of the disc to prevent the snow from melting. The entire surface of the disc is preferably available for skiing with snow conditioning and grooming apparatus (49, 52) being mounted away from the surface, or selectively retractable from the surface. The upper surface of the disc may be non-planar to set up "wave" allowing a variety of skiing conditions to be provided.

29 Claims, 13 Drawing Sheets

1
2

13
7

14

7

ROTARY SKI SLOPE

The present invention relates to a rotary ski slope. Such a rotary ski slope is intended as an alternative to a static artificial ski slope as is widely known in the art. The benefit of a rotary ski slope is that the skiing surface is moved past a skier descending the slope providing an endless surface so that, by traversing the slope, a skier can significantly prolong his descent, making it last as long as he chooses.

An example of a rotary ski slope which provides these features is shown in WO 89/02771. This discloses an inclined rotatable disc, the upper surface of which is designed to provide a ski slope. The disc is designed such that the side which moves up the incline of the slope upon rotation of the disc is a skiing zone, while the side which is moving down the incline is enclosed to provide a snow conditioning area. The snow on the skiing zone is cooled by blowing cold air across the top surface of the snow from peripherally mounted vents. This limits the maximum size of the disc which can be adequately cooled.

According to the present invention, there is provided a rotary ski slope comprising a disc, the upper surface of which is provided with a skiing surface, the disc being mounted with its main axis tilted to vertical, and at least a portion of the disc being rotatable about the main axis, wherein the outer diameter of the rotatable portion of the disc is at least 100 meters.

The invention provides an endless ski slope which can accommodate a large number of skiers, and also due to its size, improves the quality of the experience for the skiers.

Preferably, the outer diameter of the rotatable portion of the disc is at least 150 meters, and more preferably at least 200 meters.

The skiing surface may be covered with any surface suitable for skiing, such as matting of the type used on artificial slopes, artificially produced snow or real snow. In the case where artificial or real snow is used, the disc is preferably provided with a cooling system arranged to distribute coolant gas across the underside of the disc. This prevents the snow from melting and is capable of providing coolant across a disc of any diameter. It also allows the air temperature above the skiing surface to be regulated for the comfort of skiers. Preferably, the disc is supported on air bearings which are fed with refrigerated air which also provides the coolant but the disc can also be supported by other means such as a number of concentric rails attached to the underside of the disc engaging inverted static wheeled bogies.

Preferably, substantially the entire surface of the disc is available for skiing. This provides for some interesting skiing possibilities as skiers can ski down a downwardly moving surface. In the case where real or artificial snow is used, snow conditioning apparatus is required which is either positioned away from the surface of the disc, or is arranged so as to be retractable or removable from the surface of the disc. This not only greatly increases the capacity of the disc, but also avoids any safety problems by keeping skiers away from the conditioning apparatus. When artificial snow is used, it is envisaged that the snow conditioning apparatus will include one or more snow cannons arranged to direct artificial snow onto the surface of the disc. They may be positioned radially inwardly and/or outwardly of the rotatable part of the disc, or may be suspended from a gantry above the rotatable part of the disc. The snow cannons can be operated periodically to replenish the snow on the surface of the disc, and it is envisaged that they may also offer the possibility of allowing skiers to ski whilst it is "snowing" adding variety to the skiing experience.

The snow conditioning apparatus also preferably includes snow grooming apparatus for breaking up the snow to avoid it becoming compacted. This may either be mounted on a retractable mechanism so that it can selectively be moved between a position in which it can groom the snow on the disc and a position away from the skiing surface while people are skiing on the disc. Alternatively, the snow grooming apparatus may be at least one roving vehicle which is periodically driven over the surface of the disc. The snow can be groomed daily between the closing of the slope at the end of the day and the opening of the slope the following day. In addition, it may be necessary to groom the snow on one or more occasions during the day, in which case it would be necessary to clear the slope of skiers before the grooming is carried out.

The angle at which the main axis is tilted to the vertical is preferably in the range of 5 to 40°, and more preferably in the range of 10° to 20°. The optimum angle is currently believed to be substantially 15°. The angle may be fixed, or the disc may be mounted such that the angle of tilt of the axis to the vertical is adjustable. The disc may be mounted either so as to be adjustable about a horizontal axis passing through its centre or about a horizontal axis at the lowermost end edge of the disc.

The disc may have a single rotating part. However, the speed at which such a disc could be run would be limited by the translational speed of the outer periphery of the rotatable part, so that the radially innermost part of the disc would have a slow translational speed. Therefore, it is preferable for the rotatable part of the disc to be divided into a number of concentric rings, the speed of each of which is independently controllable. Thus, by rotating the radially outermost rings at a slower rotational speed than the innermost rings, a more uniform translational speed can be maintained across the width of the disc. Preferably, the disc comprises at least five movable rings.

In order to increase the variety of conditions available to the skier, at least one of the rings may be rotatable in the opposite direction to at least one of the other rings.

Preferably the disc also comprises at least one static region, which may be at the centre of the disc, at the outer periphery of the disc, or may be one or more rings positioned between rotatable rings. The static regions offer refuge for the skiers and also connection points for access structures to and from the slope.

Preferably, when a pair of counter-rotating rings are provided, they are separated by a static ring or a normally moving ring that is stationary in order to avoid high relative velocity at the junction between adjacent ring which may excessively disturb the surface of the snow. A conditioning device can be mounted in the circumferential joint between the two rings at the upper part of the disc to constantly condition and restore the snow surface at the joint. Alternatively, to avoid excessive disturbance of the surface of the snow at the junction of adjacent relatively moving rings, the upper surface of the ring is preferably raised towards the inner and outer edges of the ring such that the depth of snow cover at the junction is minimal so reducing disturbance of the snow surface. To allow for any problems with lack of snow at the edges of the rings, the upper surfaces of the rings towards the edges are preferably covered with artificial ski matting.

In its simplest form, the upper surface of the disc is planar. However, in order to provide a greater variety of skiing conditions, a non-planar upper surface may be provided. In one form, this may be provided by at least one of the rings providing a frustoconical skiing surface.

Alternatively, if the skiing surface of the disc is flexible and is supported to run on a non-planar support, the surface can be arranged such that, at certain locations around the circumference as determined by the support, the skiing surface is raised or lowered with respect to a planar portion of the skiing surface. This effectively sets up a "standing wave" which can be used, for example, to provide a jump or a flat area. Preferably, the support surface is arranged such that, at any point around the disc, a radial line across the skiing surface is straight. This avoids any need for the disc to have to flex across the diameter of the disc, with the associated problems that this would cause, particularly when the disc is made up of concentric rings.

Preferably, the disc or each ring is driven by a linear motor along a circular support rail. The disc or each ring is preferably divided into a plurality of arcuate segments. The segments are preferably joined on site to form a continuous unbroken ring with a planar upper surface so as to maintain snow surface integrity. Alternatively, the segments can be joined by a flexible boot to accommodate thermal expansion of the segments or to enable "standing wave" implementations. However, a potential problem arises in that towards the bottom of the slope, the weight of the entire disc acts the segments tending to compress the flexible boot thereby distorting the disc. Preferably, therefore, in this embodiment, the linear motor is arranged to drive each segment independently so as to maintain a desired separation between segments and to minimise disturbance of the snow surface.

An example of a ski slope constructed in accordance with the present invention will now be described with reference to the accompanying drawings, in which.

Figure 5:
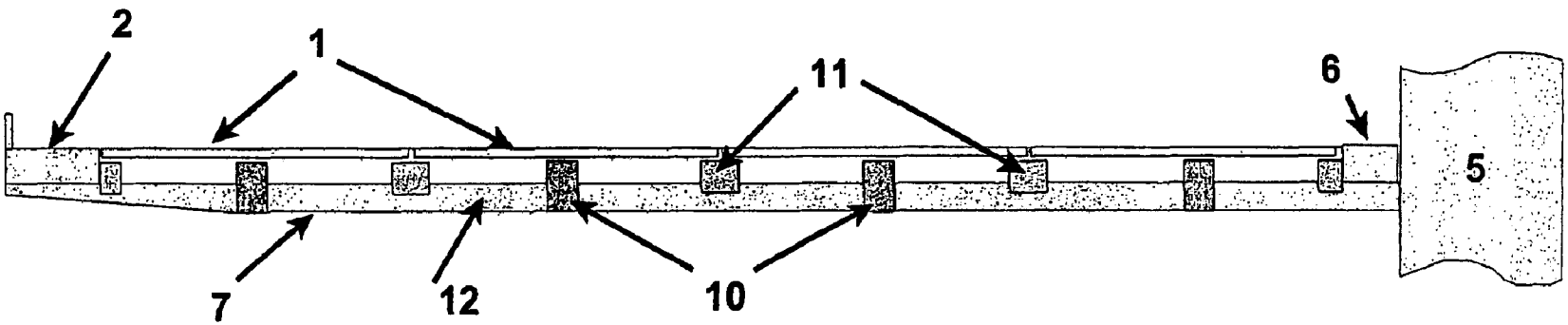
FIG. 5 is a cross-section similar to that shown in FIG. 4B showing half of the disc in greater detail.
Figure 6:
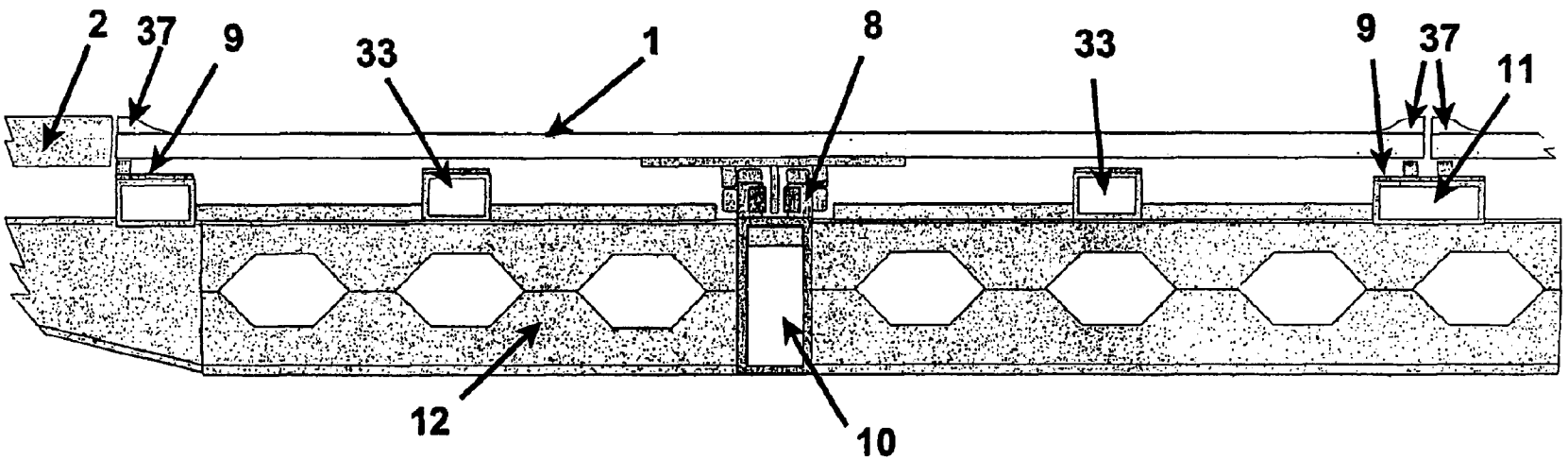
FIG. 6 is a cross-section similar to FIG. 5 showing one ring in greater detail still.
Figure 13A:
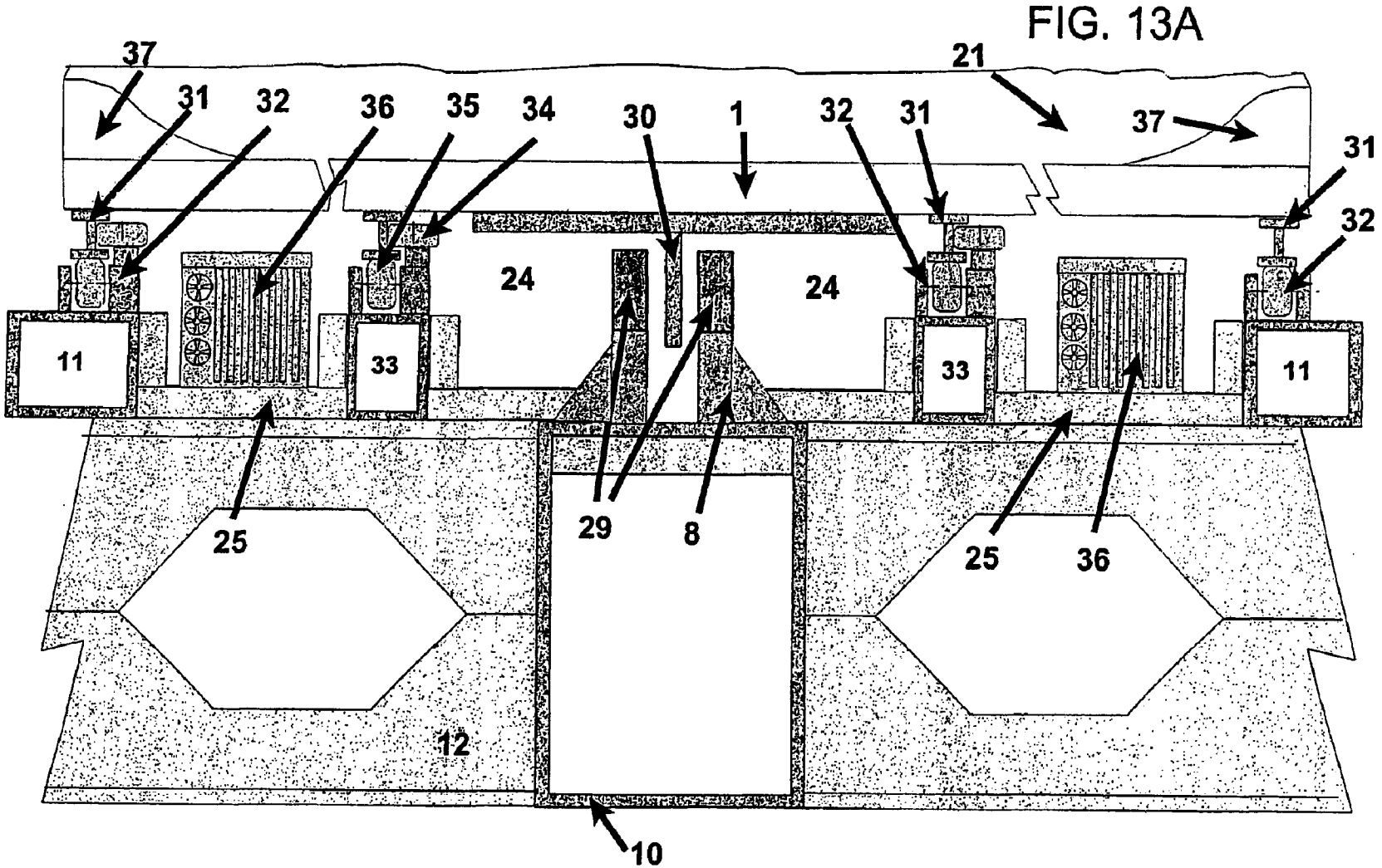
Figure 13B:
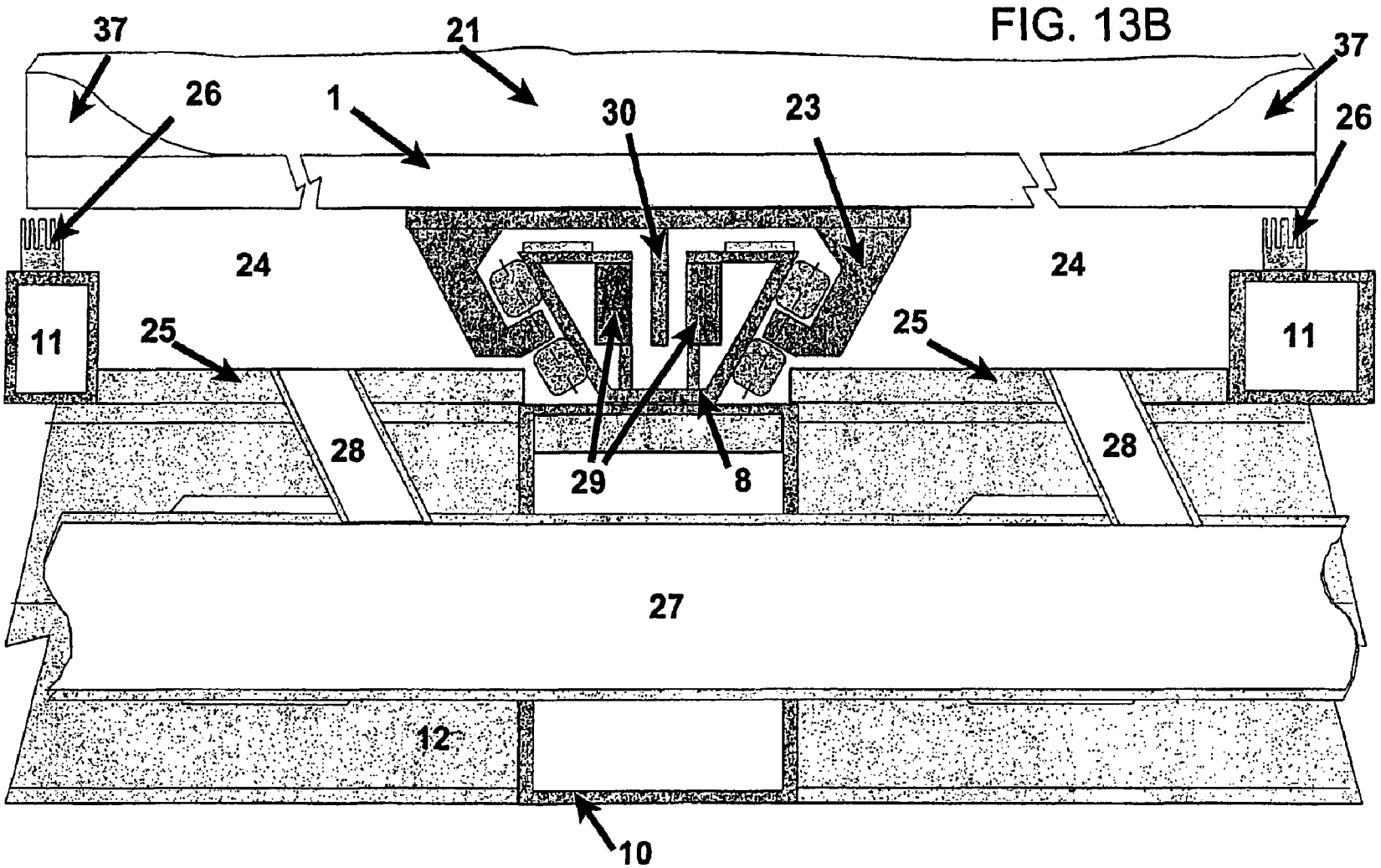
Figure 14:
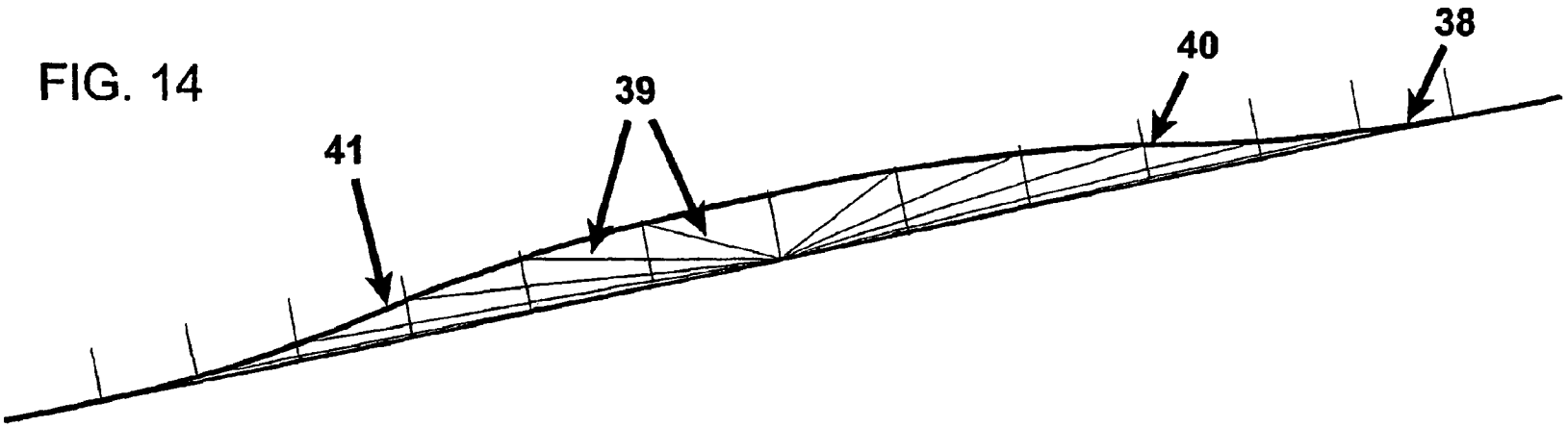
Figure 15:
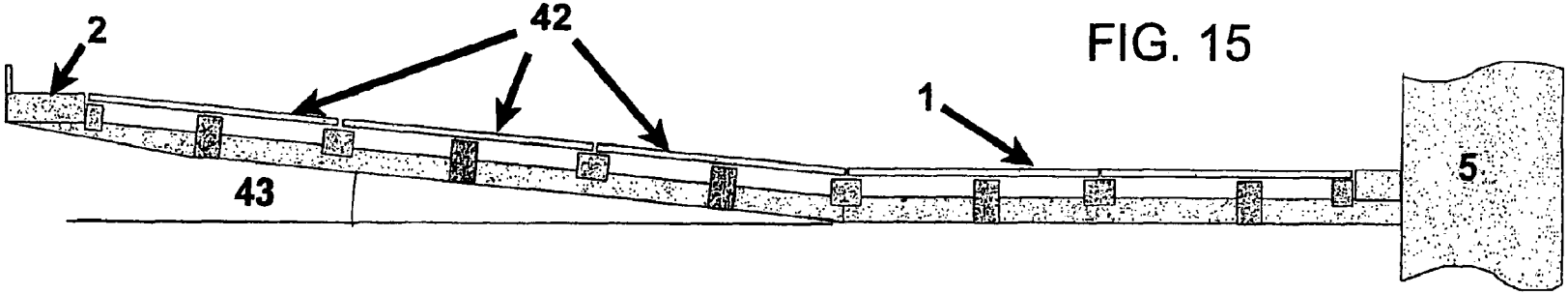
Figure 16:
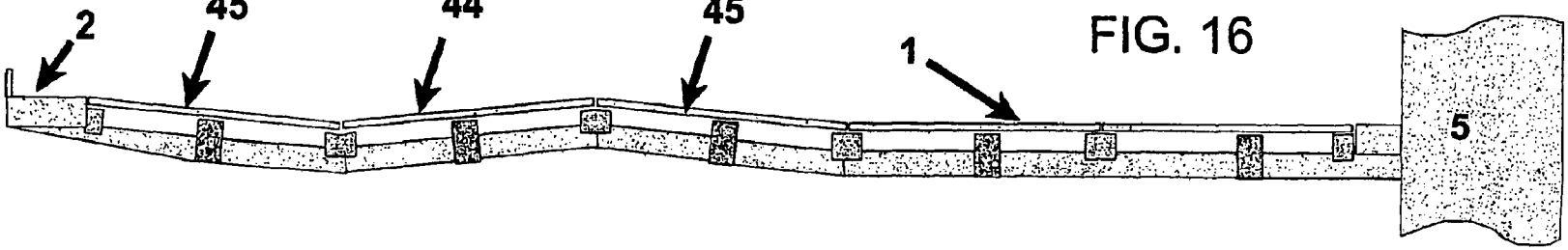
Figure 17:
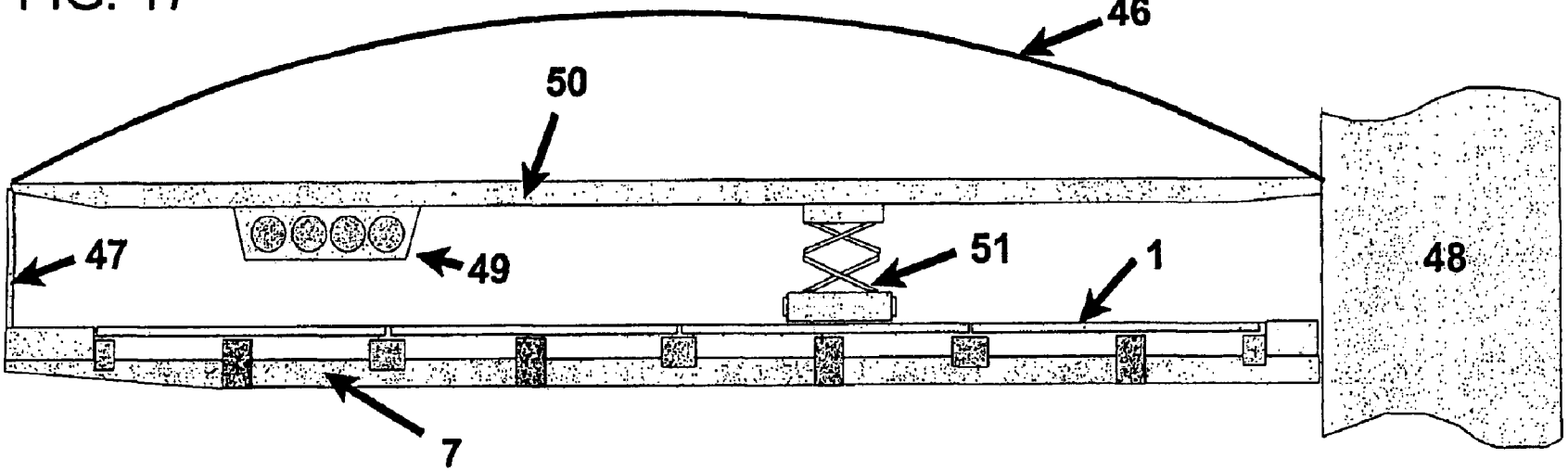

FIGS. 13A and 13B are views similar to FIG. 6 showing in further detail still, in the case of FIG. 13A, circumferential rails mounted on the underside of the disc supported on inverted static bogies, air cooled chamber and linear motor arrangement and the upward bevelled inner and outer ring edges, and in the case of FIG. 13B, showing alternatively, the support, air bearing and linear motor arrangement and the upward bevelled inner and outer ring edges;

FIG. 14 is a schematic side view illustrating the profile of the outermost edge of the disc with a "standing wave" configuration;

FIG. 15 is a view similar to FIG. 5 showing an alternative slope profile;

FIG. 16 is a view similar to FIG. 15 showing a further alternative profile;

FIG. 17 is a view similar to FIG. 5 showing an enclosure and snow conditioning apparatus.

Figure 1:
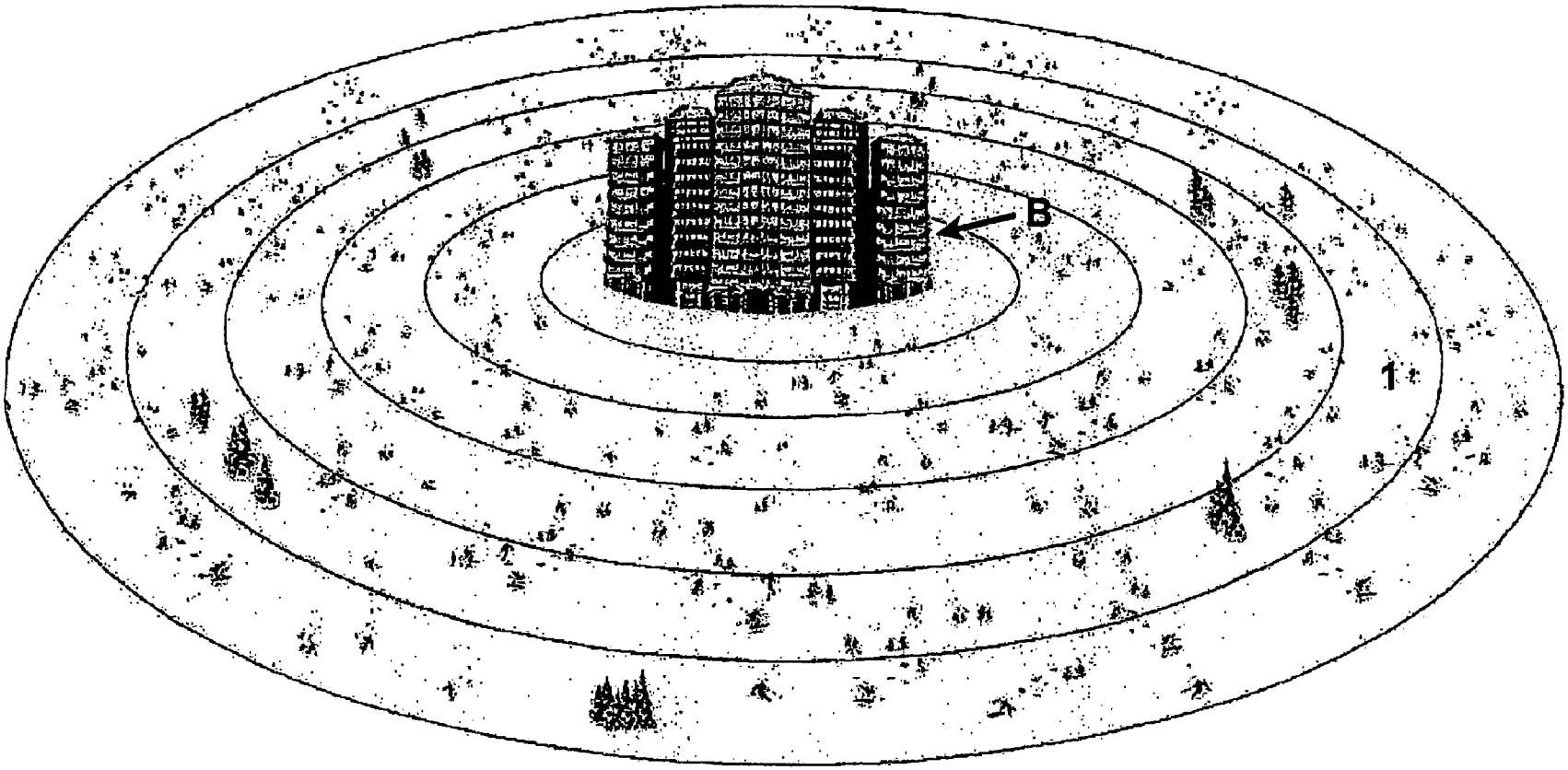
FIG. 1 is a schematic perspective view of a full size ski slope as it is intended to be used.
Figures 2A, 2B:
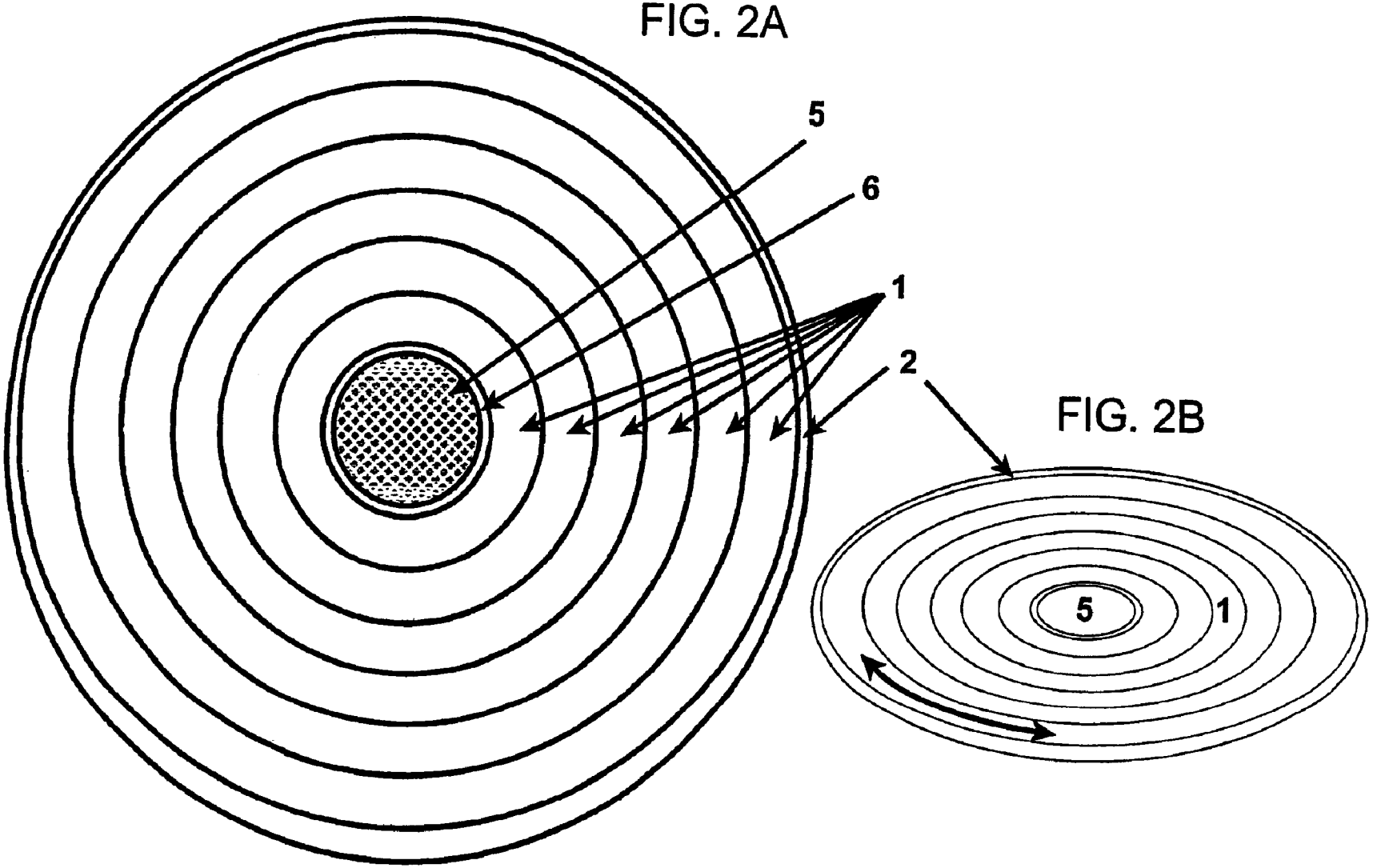
FIG. 2A is a plan view of the ski slope.
FIG. 2B is a perspective view of the ski slope in its inclined configuration.
Figure 3:
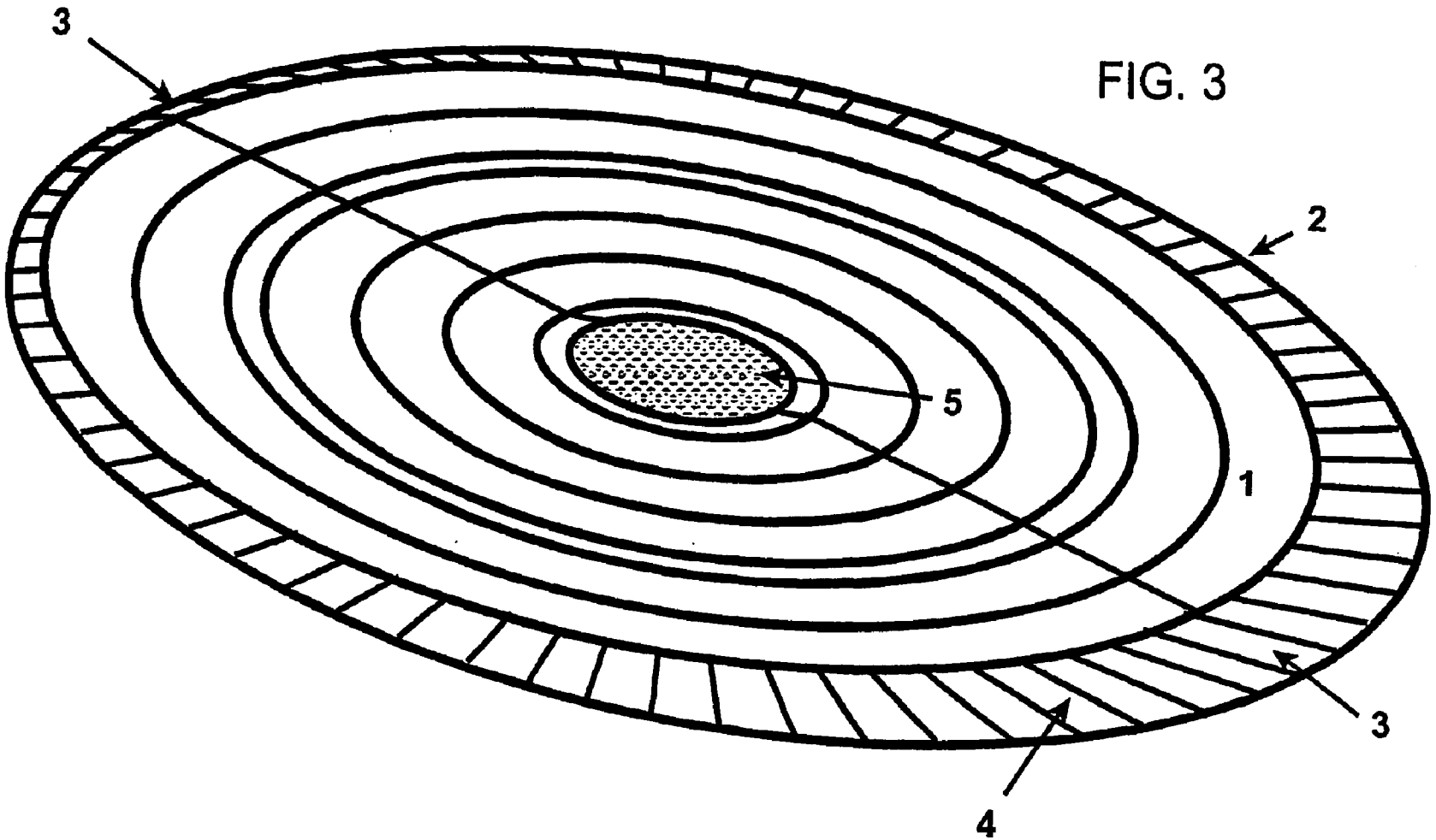
FIG. 3 is a view similar to FIG. 2 showing the ski slope in greater detail.
Figures 4A, 4B:
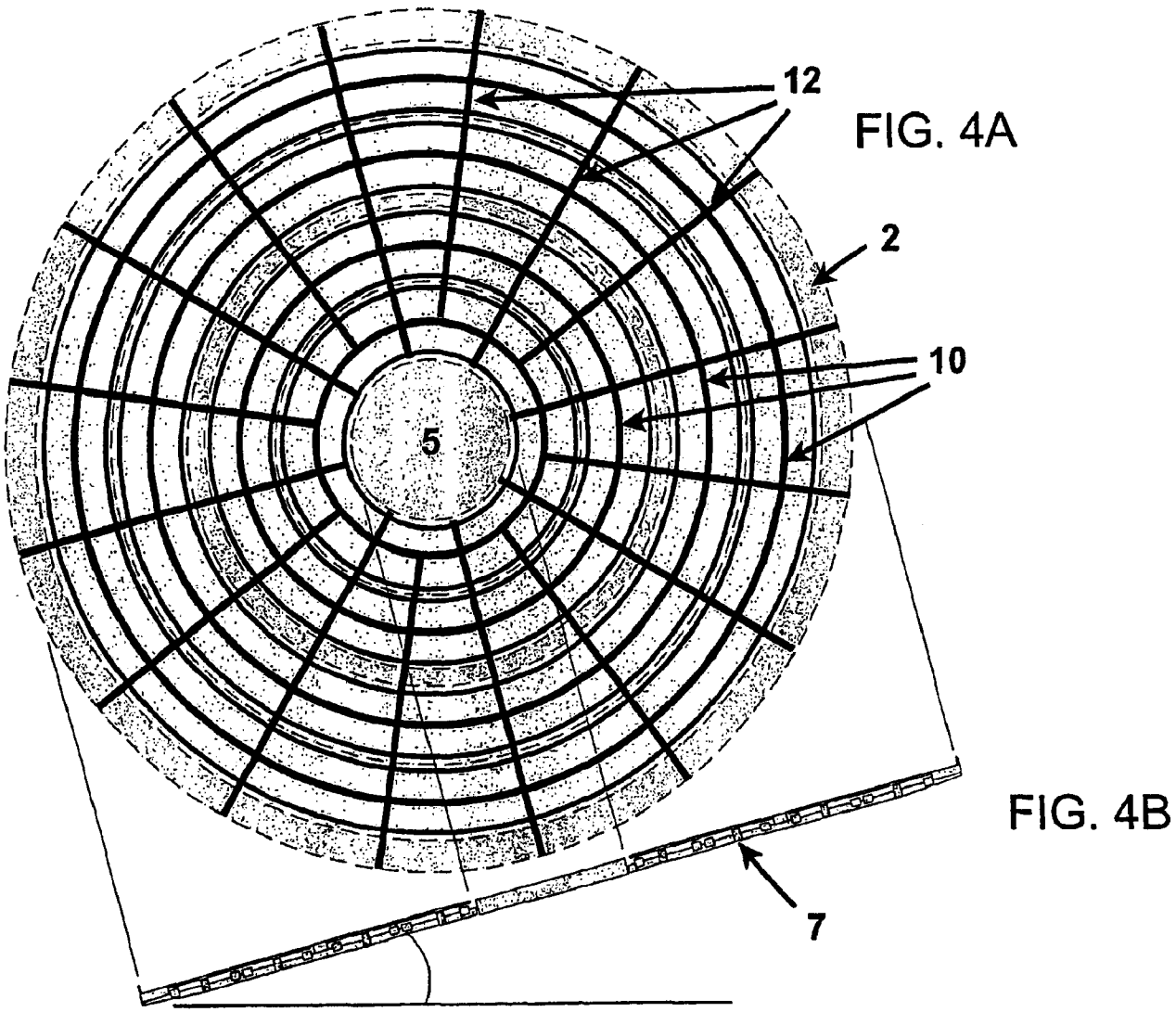
FIG. 4A is a schematic underneath plan of the ski slope showing the support structure.
FIG. 4B is a section through a diameter of FIG. 4A.

The rotary ski slope shown at FIGS. 1 to 3 is made up of a number of planar concentric rings 1. The overall diameter of the rotary ski slope in this embodiment is between 250 meters and 300 meters and the whole is inclined at approximately 15° to 20°. As seen in FIG. 1, this can accommodate a vast number of skiers. In this embodiment, the ski slope has six rings, each approximately 15 meters to 20 meters wide, each covered with snow. Each of the rings can rotate in either direction at speeds of up to 15 meters/second and are separately controlled. Any of the rings can rotate or remain stationary. An outer static access ring 2, between 5 meters and 10 meters wide, enables access for skiers to the outermost rotating ring. This outer static ring is arranged so that any radial is horizontal as shown in FIG. 3. Accordingly, at the top and bottom of the inclined ski horizontal 3 and, in the lower part 4, which can be extended in width, provides a static slope suitable for the training of novices. The central area 5, with a diameter preferentially between 30 meters and 50 meters, provides services and access to the slope for skiers and may provide space for buildings B as shown in FIG. 1. It is surrounded by a static access ring 6, of approximately 5 meters in width, similarly inclined as the outer static ring, for immediate access and egress for skiers to and from the adjacent inner rotating ring.

In FIGS. 4 to 8, a fabricated steel structure 7 provides support for the ring centre guide ways or rails 8 and peripheral guide ways or rails 9 supporting the rotating rings 1. In this embodiment, the ski slope support structure is made up of concentric circular support box beams 10 under the centre of each ring and supporting the main guide rail with smaller circular box beams 11 at the periphery of each ring. Additional smaller concentric circular box beams 33 can be deployed within the peripheral guideways to accommodate multiple guideways or rails. Radial stringers 12 locate and join the circular box beams to maintain concentricity and planar tolerances.

Figures 7A, 7B, 8A, 8B:
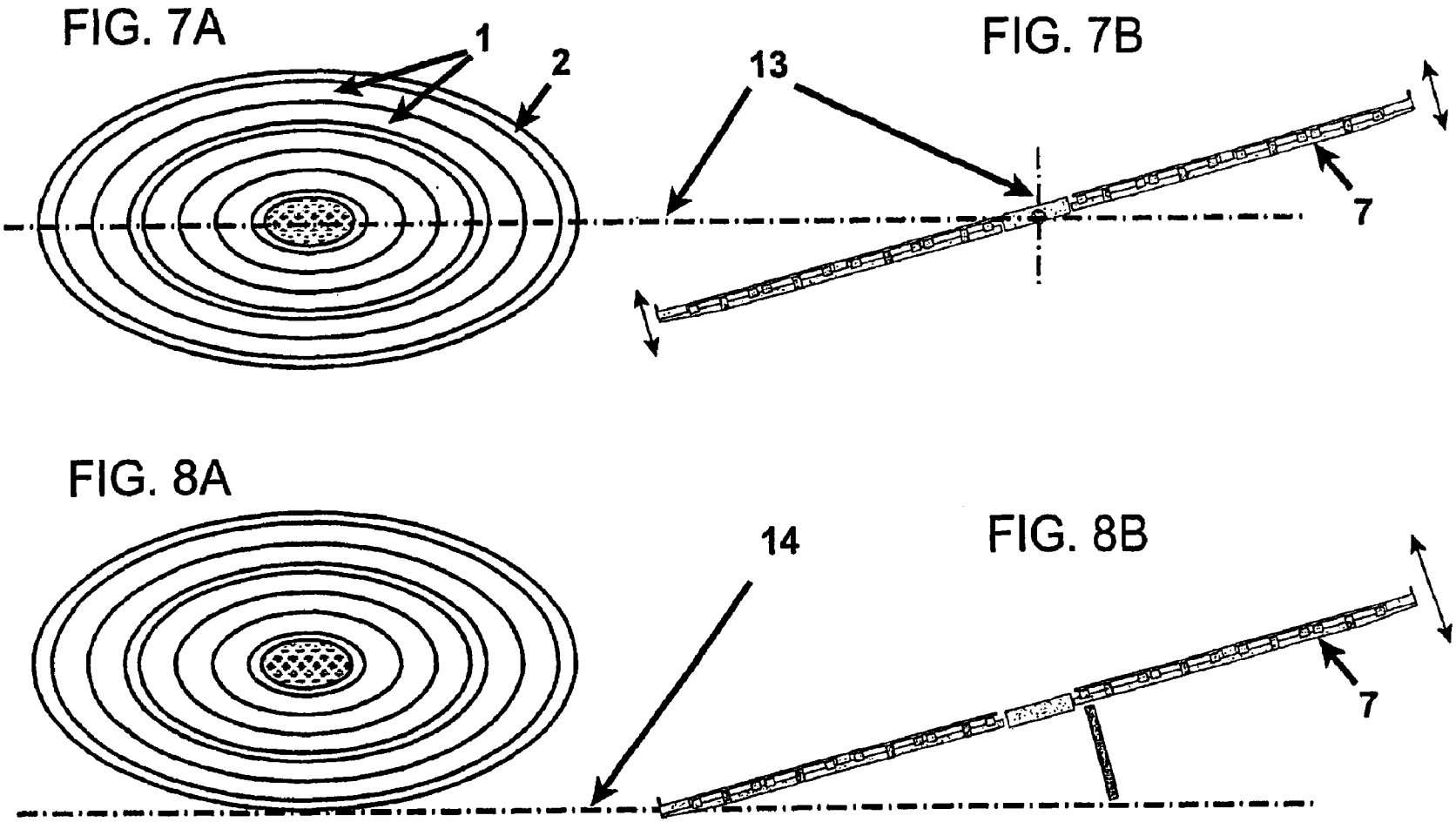
FIGS. 7A and 7B are respectively a schematic front view and a schematic diametric cross-section showing a first example of a tilt axis.
FIGS. 8A and 8B are respectively a schematic front view and a schematic diametric cross-section showing a second example of a tilt axis.

In FIGS. 7 and 8, the whole of the ski slope and support structure itself 7 can be tilted over a range of approximately 10° and may preferentially tilt about a balanced central horizontal pivot axis 13 or pivot about a horizontal axis passing through the lower edge of the support structure 14. The tilting can be achieved used using a system of hydraulic jacks (not shown).

Figure 9:
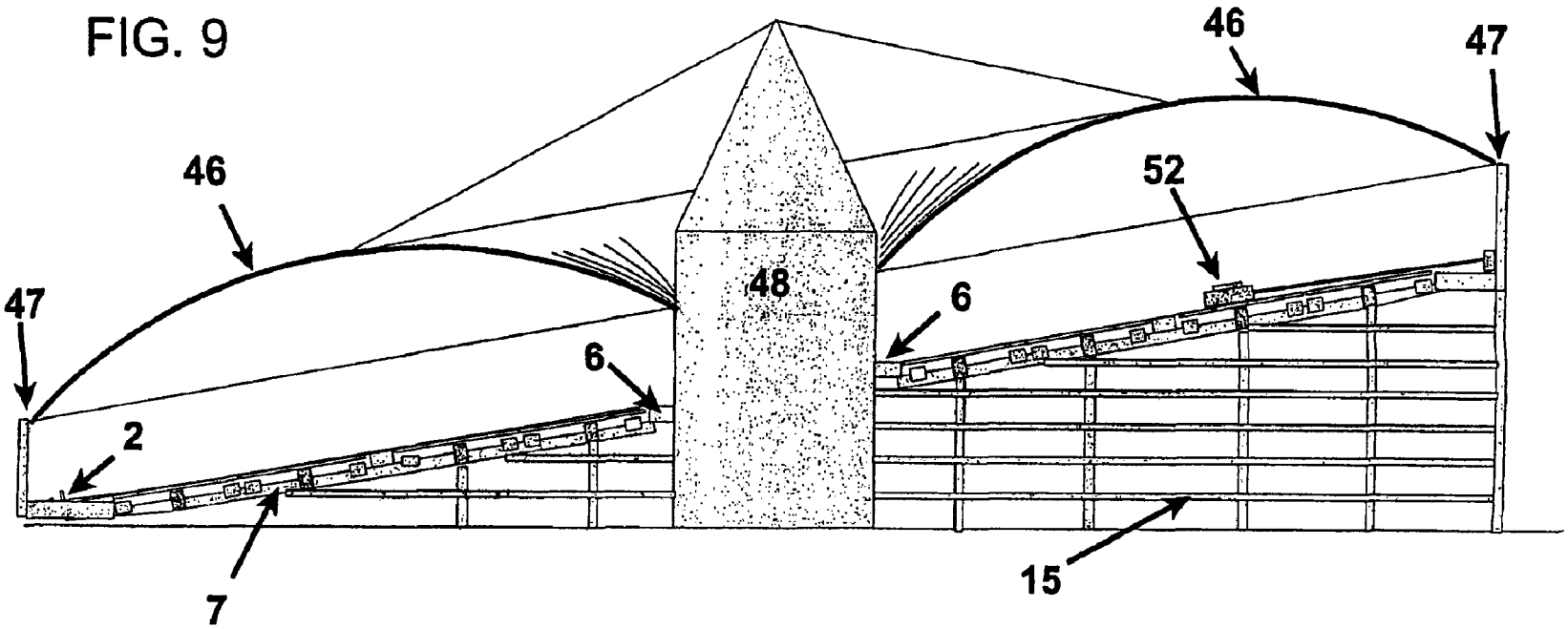
FIG. 9 is a section through a ski slope similar to FIG. 4B showing an enclosure for the slope.

In the embodiment, as shown in FIG. 9, the ski slope support structure is supported by a sub-structure 15 and the angle of inclination is fixed.

Figure 11:
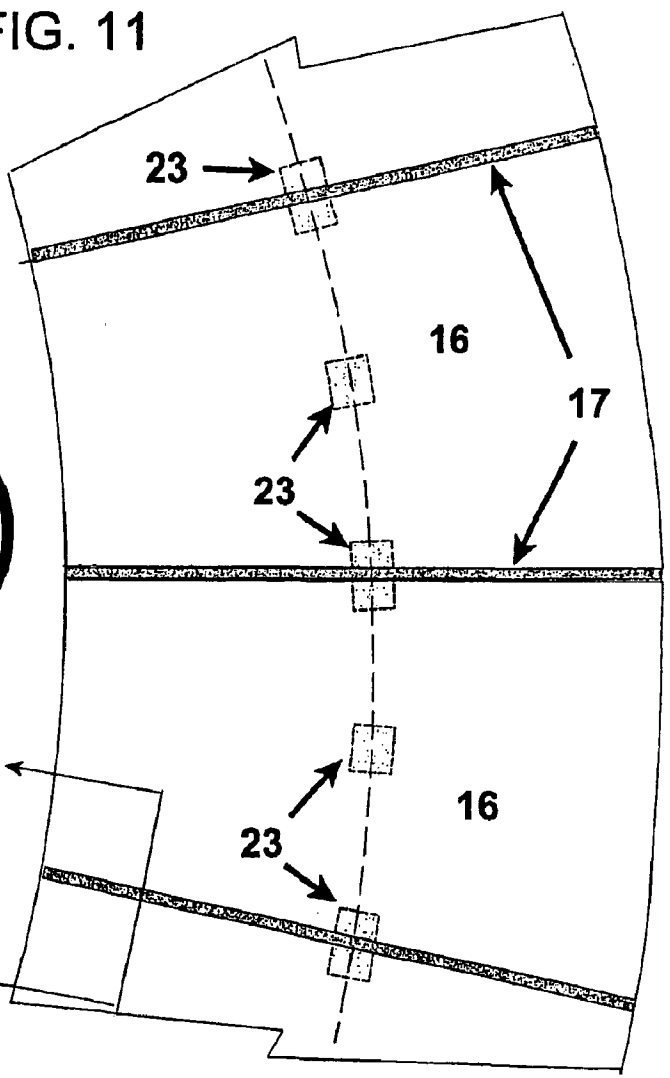
FIG. 11 is a detailed view of the ringed portion XI from FIG. 10.
Figure 10:
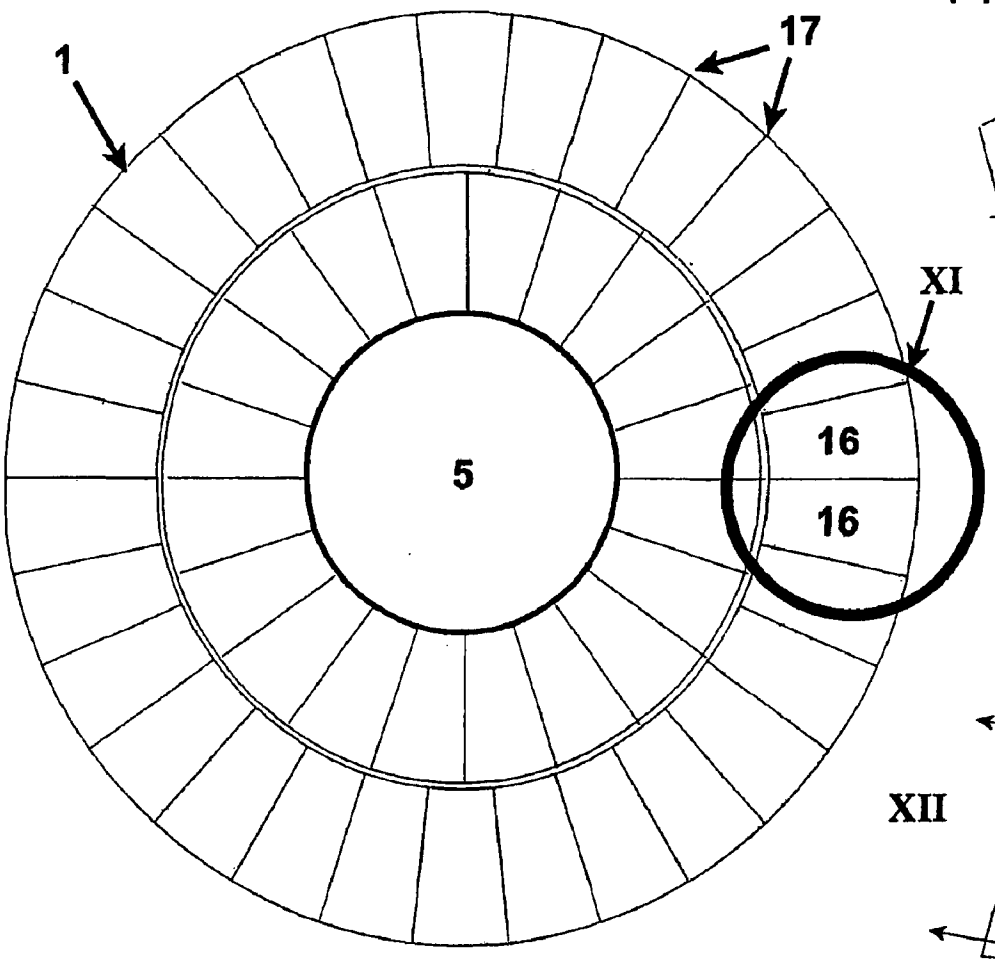
FIG. 10 is a plan view of a single ring.
Figure 12:
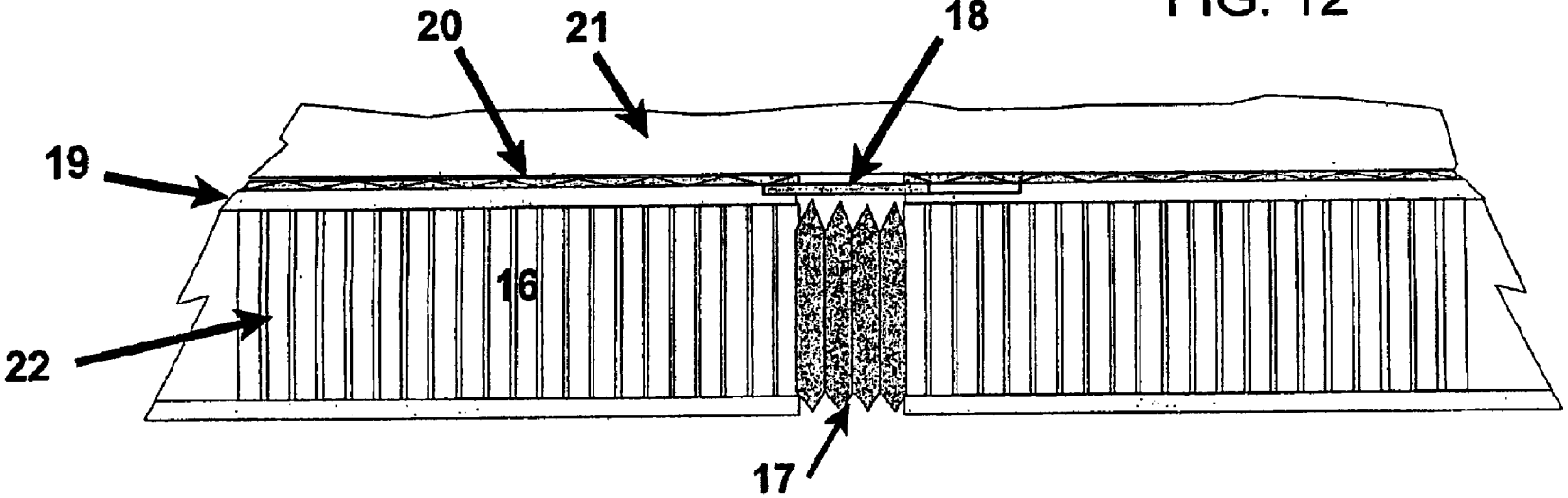
FIG. 12 is a section through XII—XII as shown in FIG. 11.

In FIGS. 10 and 11, the rotating rings 1 are each made of a number of segments 16. In one embodiment, the segments are assembled on site to form a continuous rigid ring. In another embodiment, the segments are separated by a flexible pressurised boot 17 positioned along the radial edge to allow for thermal contraction and expansion. The radial gap between the segments occupied by the pressurised flexible boot is between 25 mm and 100 mm. The boot is covered on the upper side by a stiff flap 18 shown in FIG. 12, preventing accumulation of snow above the boot, and is attached to the radial edge of one segment and able to slide with respect to the adjacent segment to accommodate any relative movement in the direction of rotation. The segments 16 are between 2 meters and 20 meters in circumferential length. In both embodiments, the segment structure has a light alloy profiled top deck 19 to which is attached artificial ski matting 20 or similar to act as a bond for the artificially created snow surface 21. The top deck 19 is supported by a honeycomb or lattice 22 to provide the necessary longitudinal and radial stiffness. In these embodiments, to avoid excessive disturbance of the surface of the snow at the junction of adjacent moving rings 1, the surface of the ring has bevelled portions 37 which raise the upper surface of the ring at the inner and outer edges of the ring such that the depth of snow cover applied to the surface of the ring adjacent to the junction between the rings is minimised. This reduces disturbance and breakdown of the snow surface at the edge regions. The bevelled portions 37 are preferably covered in artificial ski matting, so that, if the snow is worn away at a particular location, it is still possible to ski over the surface.

In the embodiment using a continuous rigid ring, each ring has attached to the underside between two and four concentric rails 31, as shown in section in FIG. 13A, supported on inverted static bogies 32 mounted on corresponding concentric support box beams 11 and 33. The bogies include a wheel 34 positioned at 90° to load bearing wheels 35 to accommodate the lateral forces arising from the incline of the disc.

In this embodiment, an annular air box is located under each ring bounded by a thermally insulated lower plate enclosing the space between the radial stringers 12 and the centre and circumferential box beam 10 and 11 and by circumferential non-contact seals (not shown), mounted between bogies along the circumferential box beams 11. Multiple evaporators or cooling circuits 36 of one or more heat pumps (not shown), located beneath the ring support structure 7, are distributed at intervals within the annular air box 24 to refrigerate the air within the air box beneath each ring to a temperature of between −5° C. and 10° C. The rotation of the ring serves to circulate the air in the air box 24 so as to pass over the coils of the evaporator so cooling the air and to achieve an even temperature distribution throughout the air box 24. This serves to maintain the temperature of the snow base on the surface of the ring 1 uniformly below freezing point.

In the embodiment made up of segments 16 separated by flexible boots 17, depending on the circumferential length, each segment is mounted on two or three suspension bogies 23, shown in section in FIG. 13B, positioned on the centre-line of each ring and engaging with the centre guide way or rail 8 mounted on the support box beams 10. The leading and trailing bogies can serve additionally to support the trailing and leading edges of the leading and trailing segments respectively as shown in FIG. 11. The ring segments are supported by low pressure air ducted to individual annular air boxes 24 located under each ring and bounded by a thermally insulated lower plate 25 enclosing the space between the radial stringers 12 and the box beams 10 and 11 and by circumferential labyrinth seals 26 acting to seal the gap at the inner and outer perimeter of the segments. Other embodiments can use outrigger wheeled bogies positioned at the segment perimeters for additional support and location.

The low pressure air ducted to the air boxes 24 under each of the rings is refrigerated to a temperature of approximately −5° C. This serves to maintain the temperature of the snow on the surface of the ring below freezing point. The low pressure refrigerated air is distributed to each of the annular air boxes 24 through radial, circular sectioned ducts 27 mounted between the ring support structure radial stringers 12, passing successively under each ring 1, through the circular support box beams 10, and connected by short connecting ducts 28 to each annular air box to effect a constant pressure distribution and even cooling effect under each corresponding ring. An annular air manifold, not shown, encircling the central area 5, supplies the radial air ducts 27 and is fed with pressurised, refrigerated air by appropriate refrigeration equipment and compressors, not shown, located under the ring support structure 7.

Each ring 1 is driven by synchronous or asynchronous linear motors 29 positioned at regular assigned intervals around the ring centre guide way or rail 8 and mounted within the guide way in pairs either side of a continuous reaction or stator fin 30, attached to the underside of each ring segment. In the embodiment made up of segments 16 separated by flexible boots 17, the speed and positioning of each ring segment is separately controlled such that the separation between adjacent segments remains constant irrespective of whether the segments are descending or ascending the incline.

In a variant of the planar rotary ski slope, seen schematically in FIG. 14, the planar disc configuration is modified such that the skiing surface 38 is progressively raised and lowered relative to the planar surface. At any point on the raised portion of the skiing surface, a radial line 39 from the circumference to the centre of the skiing slope is straight. The configuration in this example first reduces the inclination of the slope on the outer ring to approximately 10° less than inclination of the base planar inclination at region 40 and then progressively increases the slope to a maximum of approximately 10° more than the planar inclination at region 41 before reverting to the base inclination. To accommodate the change in inclination, the ring segments are shorter in circumferential length to provide the necessary flexibility to closely follow the 'standing wave' profile and the support structure, comprising box beams 10, 11 and bogies 23, is raised from the planar configuration to generate the profile. This variation provides varying angles of slope suiting both the novice and expert skiers and more closely emulates actual downhill skiing conditions.

In other implementations shown in half section in FIGS. 15 and 16 and designed to extend the variety of experience and realism of the rotary ski slope, one or more of the rings are in a frustoconical form. In the implementation shown in FIG. 15, three of the outer rings 42 are inclined radially towards the centre of the disc at an angle of between 5° and 10°. In this form, skiers, in accelerating down the ring in a curving trajectory and leaning towards the centre to counter centrifugal forces, will be compensated by the 'banking' of the ring extending simulating of 'straight line' skiing. In the implementation shown in FIG. 16, the three outer rings are arranged such that the next to outer ring 44 has a reverse camber compared with the adjacent rings 45 inclined radially towards the centre. In this implementation, among other manoeuvres, skiers can move rapidly from the inner inclined ring to the reverse camber ring to simulate skiing across a steep snow slope before turning into the outer ring.

As shown in FIG. 9, a sectional view, the rotary ski slope is enclosed by a circular dough-nut shaped roof 46, appropriately insulated to minimise ingress of heat, engaging the outer perimeter walls 47 and the central structure 48 providing access and facilities for skiers. The resulting enclosure is maintained at a comfortable temperature for skiers, typically, of approximately −2° C. by distributing conditioned air, provided by plant not shown, in an appropriate manner within the enclosure.

To allow for the whole surface of the rotary ski slope to be available for skiing, as shown in FIG. 17, snow cannons 49 of proprietary manufacture are suspended below a gantry

50 extending from the central structure 48 to the outer perimeter wall 47 of the slope. Snow cover can be applied in the first instance to each individual ring by slowly rotating the rings under the cannons until full cover is achieved. Snow replenishment can occur over individual rings, simulating natural snow fall, without interrupting skiing. For the same reasons, retractable snow grooming, milling or conditioning equipment 51 is suspended from the same gantry. Alternatively, a powered snow grooming vehicle 52, as shown in FIG. 9, its speed synchronised with the slow moving ring, can by lowered from the apex of the slope to sequentially condition each ring. Conditioning takes place after the slope has been closed for the day.

What is claimed is:

1. A rotary ski slope comprising:

a disc having an upper surface provided with a skiing surface and a main axis tilted to vertical, at least a portion of the disc being rotatable about the main axis; and a cooling system arranged to distribute a coolant gas across an underside of the disc;

wherein the outer diameter of the rotatable portion of the disc is at least 100 meters.

2. A ski slope according to claim 1, wherein the outer diameter of the rotatable portion of the disc is at least 150 meters.

3. A ski slope according to claim 1, wherein the outer diameter of the rotatable portion of the disc is at least 200 meters.

4. A ski slope according to claim 1, wherein the disc is supported on air bearings which are fed with refrigerated air which also provides coolant.

5. A ski slope according to claim 1, wherein substantially the entire surface of the disc is available simultaneously for skiing.

6. A ski slope according to claim 5, wherein a snow conditioning apparatus is either positioned away from the surface of the disc, or is arranged so as to be retractable or removable from the surface of the disc.

7. A ski slope according to claim 6, wherein the snow conditioning apparatus includes one or more snow cannons arranged to direct artificial snow onto the surface of the disc.

8. A ski slope according to claim 7, wherein the one or more snow cannons are positioned radially inwardly or outwardly of the rotatable part of the disc, and/or suspended from a gantry above the rotatable part of the disc.

9. A ski slope according to claim 6, wherein the snow conditioning apparatus includes a snow grooming apparatus for breaking up the snow.

10. A ski slope according to claim 9, wherein the snow grooming apparatus is mounted on a retractable mechanism so that it can selectively be moved between a position in which it can groom the snow on the disc and a position away from the skiing surface.

11. A ski slope according to claim 9, wherein the snow grooming apparatus is at least one roving vehicle.

12. A ski slope according to claim 1, wherein the angle at which the main axis is tilted to the vertical is in the range of 5 to 40° and preferably 10 to 20°.

13. A ski slope according to claim 12, wherein the angle at which the main axis is tilted to vertical is substantially 15°.

14. A ski slope according to claim 1, wherein the angle at which the main axis is tilted to the vertical is adjustable.

15. A ski slope according to claim 14, wherein the disc is mounted so as to be adjustable about a horizontal axis passing through its centre.

16. A ski slope according to claim 14, wherein the disc is adjustable about a horizontal axis at the lowermost edge of the disc.

17. A ski slope according to claim 1, wherein the rotatable part of the disc is divided into a number of concentric rings, the speed of each of which is independently controllable.

18. A ski slope according to claim 17, wherein there are at least five movable rings.

19. A ski slope according to claim 17, wherein at least one of the rings provides a frustoconical skiing surface.

20. A ski slope according to claim 17, wherein at least one of the rings is rotatable in the opposite direction to at least one of the other rings.

21. A ski slope according to claim 20, wherein the concentric rings include a pair of counter-rotating rings separated by a static ring.

22. A ski slope according to claim 17, wherein the upper surface of at least one ring is preferably raised towards the inner and outer edges of the ring.

23. A ski slope according to claim 22, wherein the raised parts of the upper surface are covered with artificial ski matting.

24. A ski slope according to claim 22, wherein, at any point around the disc, a radial line across the skiing surface is straight.

25. A ski slope according to claim 24, wherein the linear motor is arranged and controlled to drive each segment independently so as to maintain a desired separation between segments.

26. A ski slope according to claim 1, wherein the disc comprises at least one static region.

27. A ski slope according to claim 1, wherein the skiing surface of the disc is flexible and is supported to run on a non-planar support, so that, at certain locations around the circumference, the skiing surface is raised or lowered with respect to a planar portion of a skiing surface.

28. A ski slope according to claims 27, wherein the disc or each ring is divided into a plurality of arcuate segments joined by a flexible boot.

29. A ski slope according to claim 1, wherein the disc or each ring is driven by a linear motor along a circular support rail.

* * * * *